United States Patent [19]

Mowbray

[11] 4,202,303

[45] May 13, 1980

[54] FUEL SYSTEMS FOR COMPRESSION IGNITION ENGINES

[75] Inventor: Dorian F. Mowbray, Burnham, England

[73] Assignee: Lucas Industries Limited, Birmingham, England

[21] Appl. No.: 889,298

[22] Filed: Mar. 23, 1978

[30] Foreign Application Priority Data

Mar. 26, 1977 [GB] United Kingdom ..... 12791/77

[51] Int. Cl.[2] ..... F02M 45/00

[52] U.S. Cl. ..... 123/139 AQ; 123/139 BG; 123/127; 261/44 C

[58] Field of Search ..... 123/139 AP, 139 AQ, 123/139 BG, 32 ST, 75 B, 127, 27 GE; 261/44 C

[56] References Cited

U.S. PATENT DOCUMENTS

| | | | |
|---|---|---|---|
| 2,646,265 | 7/1953 | Bareham et al. | 261/44 C |
| 3,174,470 | 3/1965 | Von Seggern et al. | 123/32 ST |
| 3,330,543 | 7/1967 | Mennesson | 261/44 C |
| 3,443,552 | 5/1969 | Von Seggern et al. | 123/32 ST |
| 3,734,473 | 5/1973 | Moriya et al. | 261/44 C |
| 4,080,109 | 3/1978 | Green | 123/139 AQ |

FOREIGN PATENT DOCUMENTS

| | | | |
|---|---|---|---|
| 966380 | 4/1975 | Canada | 123/139 BG |
| 231118 | 2/1944 | Switzerland | 261/44 C |

*Primary Examiner*—Ira S. Lazarus
*Assistant Examiner*—Magdalen Moy

[57] ABSTRACT

A compression ignition engine is provided with the usual injection pump to deliver fuel to the engine cylinders. A constant vacuum carburettor is provided in the air inlet manifold of the engine to enable an alternative fuel to be mixed with the air flowing to the engine. The carburettor includes a jet and needle which are both movable to control the amount of alternative fuel supplied to the engine. The needle is controlled in accordance with the rate of air flow to the engine while the jet is controlled in accordance with the amount of fuel supplied by the injection pump to the engine.

9 Claims, 2 Drawing Figures

FUEL SYSTEMS FOR COMPRESSION IGNITION ENGINES

This invention relates to fuel systems for compression ignition engines and of the kind comprising a plurality of fuel injection nozzels for directing liquid fuel directly into the combustion spaces of the engine respectively, a fuel pumping apparatus for supplying fuel to the injection nozzles in turn and in timed relationship with the engine, said fuel pumping apparatus including control means for adjusting the quantity of fuel supplied to the combustion spaces and timing means for adjusting the timing of delivery of fuel, said timing means being responsive to the speed of the associated engine and the quantity of fuel supplied to the engine whereby with increasing engine speed, the timing is advanced and for a given speed the timing of delivery is retarded as the quantity of fuel delivered increases.

Such systems are well known and the fuel which is supplied to the engine by the apparatus has a quality which is carefully controlled. Moreover, the fuel before it is used in the system is carefully filtered to remove minute particles of dirt which would otherwise cause rapid wear of the pumping apparatus and nozzles. In most types of apparatus the fuel acts as a lubricant for some part of the apparatus It is sometimes desired to be able to supply a different fuel to the engine such fuel may lack for example, the necessary ability to provide lubrication of the parts of the apparatus or it may be dirty to the extent that a bulky filtration plant would be required or it may be that it contains varying amounts of dissolved impurity such for example as water which make it unreliable as a fuel for sole operation of an engine or it may have a low calorific value. Such a fuel could be used to supplement the quality fuel supplied to the engine thereby to reduce the consumption thereof.

The object of the present invention is to provide a fuel system of the kind specified in a form capable of supplying to the engine two types of fuel.

According to the invention a system of the kind specified comprises an adjustable throttle disposed in a conduit conveying air to the combustion spaces of the engine, means for adjusting the size of said throttle in accordance with the air flow through the conduit, a fuel jet disposed to allow fuel to flow into the stream of air passing through said conduit, a tapered needle adjustably mounted in said fuel jet, the relative position of said needle and said jet being in part determined by the means which adjusts the size of said throttle and in part by said timing means, and conduit means through which the second type of fuel is supplied to said jet.

One example of a fuel system in accordance with the invention will now be described with reference to the accompanying drawings in which.

Figure 1:
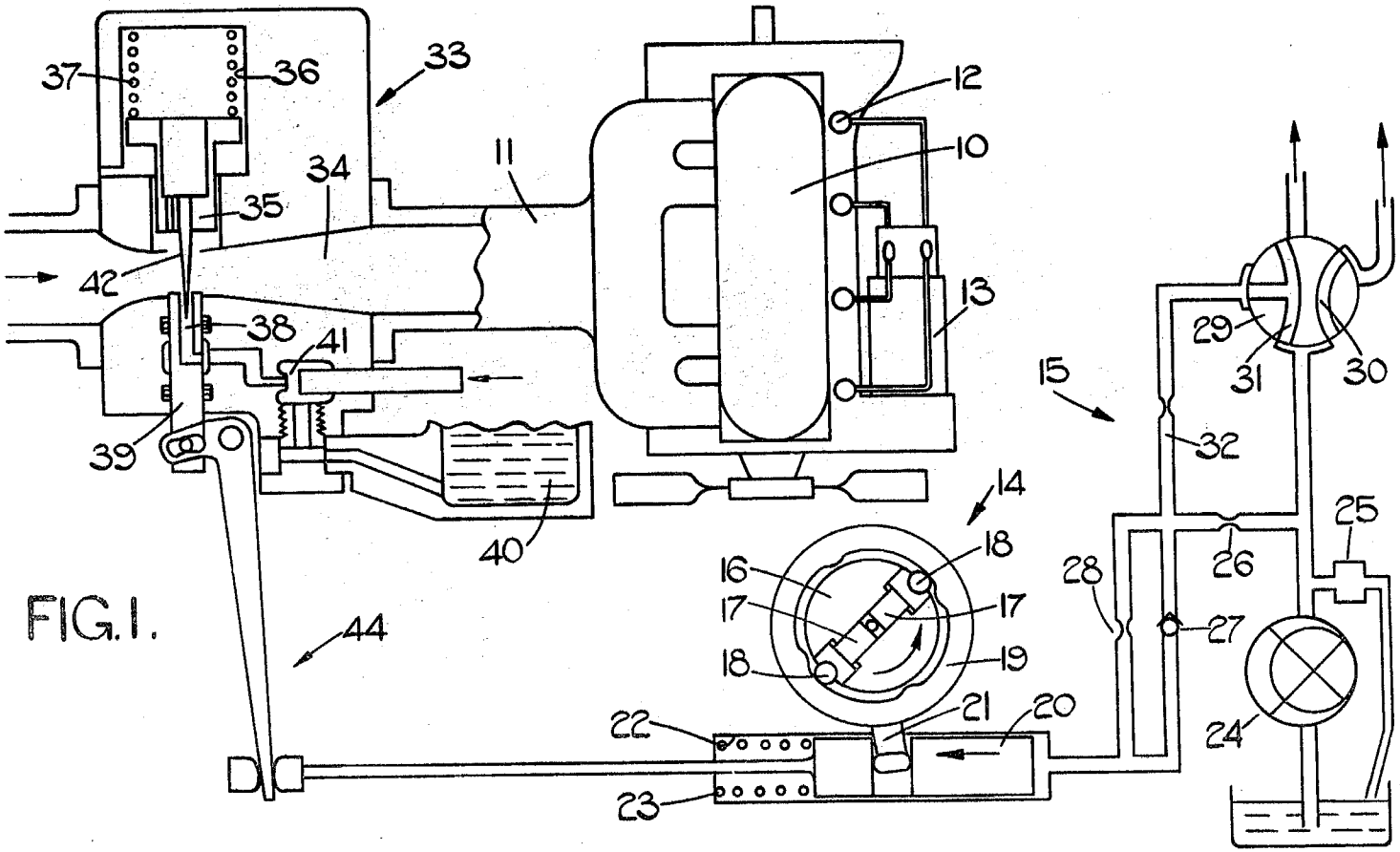
FIG. 1 is a diagrammatic lay out showing a portion of the fuel system.

Referring to the drawings a compression ignition engine is indicated at 10 having an air inlet manifold 11 and a plurality of fuel injection nozzles indicated at 12. The latter are positioned to direct fuel into the combustion spaces respectively of the engine. Fuel is supplied to the injection nozzles in timed relationship by means of a distributor type fuel injection pumping apparatus 13 this being driven by the engine. It will be appreciated that some other form of fuel injection pumping apparatus could be provided for example a so called "in-line" pumping apparatus providing the latter is equipped with some form of timing adjustment device which is responsive to the speed of the associated engine and also the rate at which fuel is supplied to the engine.

Returning to FIG. 1 of the drawings portions of the pumping apparatus 13 are indicated at 14 and 15. At 14 there is shown a rotary distributor 16 which is provided with a transversely extending bore in which is located a pair of pumping plungers 17. The plungers 17 are engaged by shoes at their outer ends and these carry rollers 18 which engage with the internal periphery of a cam ring 19 the latter having cam lobes in the particular example four equiangularly spaced about the axis of rotation of the distributor member. The cam ring 19 is angularly adjustable within the housing of the apparatus and for this purpose a fluid pressure operable piston 20 is provided which is coupled by means of a peg 21 to the cam ring. The piston is located within a cylinder 22 and a coiled compression spring 23 is provided which urges the piston and the cam ring in a direction to retard the delivery of fuel by the apparatus. Fuel under pressure is applied to the piston in order to advance the timing of delivery of fuel.

The fuel under pressure is supplied by the portion 15 of the apparatus and comprises a vane type feed pump 24 the output pressure of which is controlled so that it varies in accordance with the square of the speed of the engine by means of a control valve 25. The outlet of the feed pump is connected to the cylinder 22 by means of a first restrictor 26 and a non-return valve 27. The latter opens in the direction to supply fuel to the cylinder 22 but closes to prevent fuel flowing from the cylinder 22 thereby to minimise any tendancy for the cam ring to be moved by the reaction of the rollers 18 with the cam lobes. A small restrictor 28 is connected in parallel with the valve 27 to permit gradual return flow of fuel from the cylinder 22. Also provided is an angularly movable throttle member 29 which has a first flow passage 30 through which fuel flows to the transverse bore formed in the distributor member and containing the pumping plungers 17. The downstream end of the flow passage 30 is in full communication with a passage communicating with the aforesaid bore however, the upstream end of the flow passage 30 has adjustable communication with the outlet of the feed pump and thereby the angular setting of the throttle member 29 determines the amount of fuel which is supplied to the bore intermediate the plungers and thereby the amount of fuel which is delivered to the engine. The throttle member also has a second flow passage 31. At its upstream end the flow passage 31 has variable communication with the outlet of the feed pump and at its downstream end it has variable communication with a drain. The flow passage together with the ports in the housing in which it is located, thereby define a pair of variable restrictors the size of which depends upon the angular setting of the throttle member. The upstream member reduces in size as the quantity of fuel supplied to the engine is increased and the downstream restrictor increases in size as the quantity of fuel supplied to the engine is increased. A point intermediate the ends of the flow passage 31 is in constant communication by way of a restrictor 32 with a point intermediate the restrictor 26 and the valve 27.

As already stated the output pressure of the feed pump varies in accordance with the square of the speed at which the engine is driven and for a constant speed as the throttle member is moved to increase the amount of fuel supplied to the engine the pressure applied to the piston 20 decreases. In this manner a family of curves of piston movement and thereby the timing of delivery of fuel, against speed is obtained. The two extreme curves are indicated at 46 and 47 in FIG. 2, curve 46 representing the movement of the piston when the engine is operating on no load i.e. minimum fuel, and curve 47 representing the movement of the piston when the engine is operating at full load i.e. maximum fuel.

It will be appreciated that the fuel which is utilised in the portion of the system so far described is a fuel of reasonably consistant quality and filtered to a high degree so that particles of dirt do not cause damage to the very closely machined surfaces of the apparatus. Moreover, the fuel forms the lubricant both for the plungers and also the distributor member.

In order to supply another type of fuel to the engine there is provided what is in effect a constant vacuum carburettor this being generally indicated at 33. The body of the carburettor defines a conduit 34 through which air flows to the inlet manifold of the engine. Slidable across the conduit is an adjustable throttle constituted by the narrower end of a stepped piston 35. The wider end of the piston is located within a cylinder 36 and a passage not shown, places the wider end of the cylinder in communication with the conduit 34 downstream of the throttle. A light spring 37 is provided and this biases the piston downwardly moreover, the space between the wider end of the piston and the step in the cylinder accommodating the piston, is in communication with the atmosphere.

Figure 2:
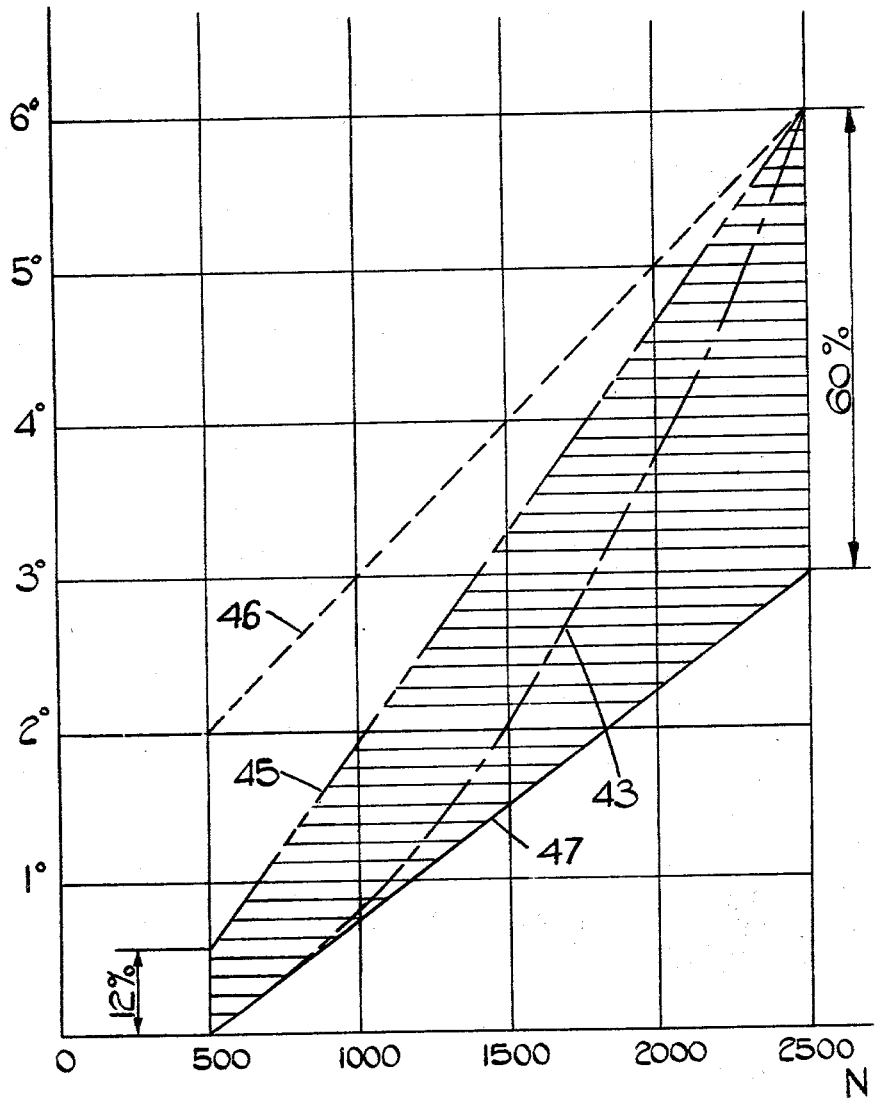
FIG. 2 shows flow diagrams in a part of the system.

Also provided is a fuel jet 38 this being formed in an adjustable body 39 positioned on the opposite side of the conduit to the piston 35. The jet 38 communicates by way of a conduit with a source of the other type of fuel generally indicated at 40 and a valve 41 is provided in the passage placing the source in communication with the jet in order that the supply of fuel can be cut off when required. The piston 35 mounts a tapered needle 42 which can enter the jet and thereby vary the effective size of the jet. If the body 39 is fixed then as the engine speed increases so that more air flows through the conduit 34, the piston 35 will rise to maintain the pressure in the downstream portion of the conduit 34 substantially constant. The needle 42 however is withdrawn from the jet and this allows more fuel to flow through the jet for consumption by the engine. A curve showing the position of the piston 35 and the needle 42 is seen at 43 in FIG. 2. It is desirable that the flow of the low grade fuel should be responsive to the load on the engine and for this purpose the position of the jet is varied in accordance with the load on the engine. This is achieved by a linkage indicated at 44 connecting the jet body 39 with the piston 20. It will be seen that as the piston 20 moves to retard the timing of delivery of fuel as occurs when the throttle member 29 is moved to increase the volume of fuel, the jet body 39 is moved downwardly thereby by virtue of the taper on the needle 42 increasing the effective size of the jet. In this manner the flow characteristic shown at 45 in FIG. 2 is obtained.

In the example the other type of fuel is alcohol which has a low calorific value and it will be seen that the proportion of alcohol going towards the total amount of fuel required by the engine at full load varies from 12% at 500 r.p.m. to 60% at 2500 r.p.m.

I claim:

1. A fuel system for supplying a high quality liquid fuel and a fuel of lower quality to a compression ignition engine having combustion spaces, comprising: a plurality of fuel injection nozzles for directing the high quality liquid fuel directly to the combustion spaces of the engine respectively, a fuel pumping apparatus connected to said injection nozzles for supplying the high quality fuel to the injection nozzles in turn and in timed relationship with the engine, said fuel pumping apparatus including a control means for adjusting the quantity of high quality fuel supplied to the combustion spaces and timing means for adjusting the timing of delivery of said fuel, said timing means being operatively connected to the engine so as to be responsive to the speed of the associated engine and the quantity of said fuel supplied to the engine, whereby with increasing engine speed the timing is advanced and for a given speed, the timing of delivery is retarded as the quantity of fuel delivered increases, an adjustable throttle disposed in a conduit conveying air to the combustion spaces of the engine, means for adjusting the size of said throttle in accordance with the air flow through the conduit, a fuel jet disposed to allow low quality fuel to flow into the stream of air passing through said conduit a tapered needle adjustably mounted in said fuel jet, said needle being operatively connected to said throttle and said jet being adjustably mounted and operatively connected to said timing means, whereby the relative position of said needle and said jet is in part determined by the means which adjust the size of said throttle and in part by said timing means, and conduit means through which the low quality fuel is supplied to said jet.

2. A fuel system according to claim 1 in which the means adjusting the size of said throttle comprises means for maintaining a substantially constant pressure downstream of said throttle.

3. A fuel system according to claim 2 in which said means includes a member defining a surface which is exposed to the pressure downstream of the throttle, said member being connected to the throttle.

4. A fuel system according to claim 3 in which the needle is carried by said throttle and the fuel jet is connected by linkage to said timing means.

5. A fuel system according to claim 4 in which said throttle comprises a piston movable across said conduit, the needle being mounted on said piston.

6. A fuel system according to claim 1 in which said conduit, the throttle, the needle and jet are the working components of a constant vacuum carburettor, the means for adjusting the size of the throttle comprising a member defining a surface upon which the air pressure downstream of the throttle acts to maintain a substantially constant pressure downstream of the throttle.

7. A fuel system according to claim 6 in which the jet is connected by linkage to said timing means.

8. A fuel system according to claim 7 in which said member and said throttle are defined by a stepped piston.

9. A fuel system according to any one of the preceding claims including means operable to prevent the flow of fuel through said jet.

* * * * *